United States Patent [19]

Jergenson

[11] 4,318,030

[45] Mar. 2, 1982

[54] LIQUID METAL ION SOURCE

[75] Inventor: Jerg B. Jergenson, Santa Barbara, Calif.

[73] Assignee: Hughes Aircraft Company, Culver City, Calif.

[21] Appl. No.: 148,852

[22] Filed: May 12, 1980

[51] Int. Cl.[3] ..... H01J 27/02

[52] U.S. Cl. ..... 315/111.81; 250/423 R; 313/232; 313/362.1

[58] Field of Search ..... 315/111.8; 313/163, 313/230, 231, 232, 362; 250/288, 423 R, 425

[56] References Cited

U.S. PATENT DOCUMENTS

| | | | |
|---|---|---|---|
| 3,233,404 | 2/1966 | Huber et al. | 313/362 X |
| 3,475,636 | 10/1969 | Eckhardt | 313/163 X |
| 4,088,919 | 5/1978 | Clampitt et al. | 313/232 X |

*Primary Examiner*—Eugene La Roche

*Attorney, Agent, or Firm*—Allen A. Dicke, Jr.; W. H. MacAllister

[57] ABSTRACT

Liquid metal ion source has cylindrical ceramic body 12 engaged by one leg of hook shaped strip heater 20 which is held in place by ceramic bushing 24. Apex 18 of the strip heater contains the ion source fuel metal and is pierced by needle 22 having sharp tip 30. Upon heating by heater current flow through needle 22 and heater leg 14 and electrical bias with an extraction electrode, tip 30 emits ions.

12 Claims, 3 Drawing Figures

LIQUID METAL ION SOURCE

BACKGROUND OF THE INVENTION

This invention is directed to a field emission liquid metal ion source which has a needle which is heated and is coated with liquid metal to emit ions.

The liquid metal ion source is a relatively new device. Several liquid metal ion sources have been made in the recent past, and those designed by Roy Clampitt and L. W. Swanson are of particular interest The Roy Clampitt source is disclosed in United Kingdom Pat. No. 1,442,998 discussed below and in several papers: R. Clampitt and D. K. Jeffries, "Miniature Ion Sources for Analytical Instruments", *Nuclear Instruments and Methods,* 149, (1978), pp. 739–742; and R. Clampitt and D. K. Jefferies "Molten Metal Field Ion Sources", *Institute for Physics Conference,* Series No. 38 (1978), Chapter 1, pp. 12–17. Swanson's work was presented as "Emission Characteristics of a Liquid Gallium Ion Source" at SEM/1979, Apr. 16–20, 1979 at Washington, D.C. by L. W. Swanson, G. A. Schwind and A. E. Bell.

Most liquid metal ion sources to date have employed metals or alloys possessing low melting points. Gallium, indium, bismuth and cesium are examples of metals which have been used in such sources. Nearly all prior liquid metal ion sources are characterized by a solid or tubular needle protruding from a closed reservoir, and the reservoir is used for holding the liquid metal. Liquifying the metal has usually been done by heating the reservoir indirectly, either radiantly or conductively. United Kingdom Pat. No. 1,442,998 shows a plurality of adjacent field emission points to which liquid ion source material is fed by capillary action.

There are considerble disadvantages to these prior art structures, particularly when they are employed with metals or alloys which have melting points higher than those listed above. These disadvantages include the fact that they are time consuming to manufacture and as a result are expensive to the user. Furthermore, the reservoirs are impossible to refill and thus a new ion source is required whenever the reservoir is exhausted. The needle is inefficiently heated and the desired temperature gradient is hard to achieve. The direct heating of the needle tip by backstreaming secondary electrons is hard to detect.

The gas field ionization "hairpin" ion source when used with a liquid metal, was initially thought to offer solutions to some of those problems. The heart of the hairpin device is a U shaped heater wire with a needle welded to the apex of the U. The heater wire was used to clean the attached needle by heating it to cause outgasing. The device was originally designed for gas field emission. L. W. Swanson first used the device as a liquid metal source by applying liquid metal directly to the needle, but a number of drawbacks are found. The hairpin device is difficult to make, due to the necessary welding of the needle to the U shaped heater wire. Since the needle is welded to the wire, the device lacks versatility because the amount of needle protrusion beyond the heater wire is fixed. Since the needle is mounted on the heater wire, and the heater wire is employed for structural support of the needle, the ion source lacks stability in the direction perpendicular to the plane of the U shaped heater wire when the heater wire is heated. As a result there is need for an improved field emission liquid metal ion source.

SUMMARY OF THE INVENTION

In order to aid in the understanding of this invention it can be stated in essentially summary form that is directed to a liquid metal ion source wherein a field emission needle having a sharp point is fixed in an insulator, and a generally hook shaped flat elongated heater strip is mounted around the point with a point extending through a perforation in the heater strip at the hook. The side of the heater strip is clamped to the outside of a mounting tube and is folded adjacent its V tip hook to provide stability and heater strength.

It is thus an object of this invention to provide a liquid metal ion source which relies on a field emission sharp needle to cause ion emission into an electric field, with the needle supported in the module, together with a ribbon foil heater strip folded and hooked on the needle adjacent its point so that the point is directly heated. It is another object of this invention to provide a liquid metal ion source with a field emission point which is of such construction that the point protrusion beyond the heater strip is readily established and is adjustable. It is a further object to provide a liquid metal ion source of the field emission needle type which is economic of construction as well as of strong construction so that is may be easily manufactured, readily available and conveniently used.

It is another object to provide a liquid metal ion source wherein the needle has sufficient structural stability so that at operating temperatures the needle point excursions from axis are minimal, thereby allowing its use in a microprobe structure. It is another object to provide a liquid metal ion source with an open reservoir (i.e., heater) construction so that additional metal can be placed in the reservoir for continued use. It is a further object to provide a heater-emission needle structure wherein heater current flows through the needle to adjacent its tip and through the heater in electrical contact with the needle.

Other objects and advantages of this invention will become apparent from a study of the following portion of this specification, the claims and the attached drawings.

DESCRIPTION OF THE PREFERRED EMBODIMENT

Figures 1, 2, 3:
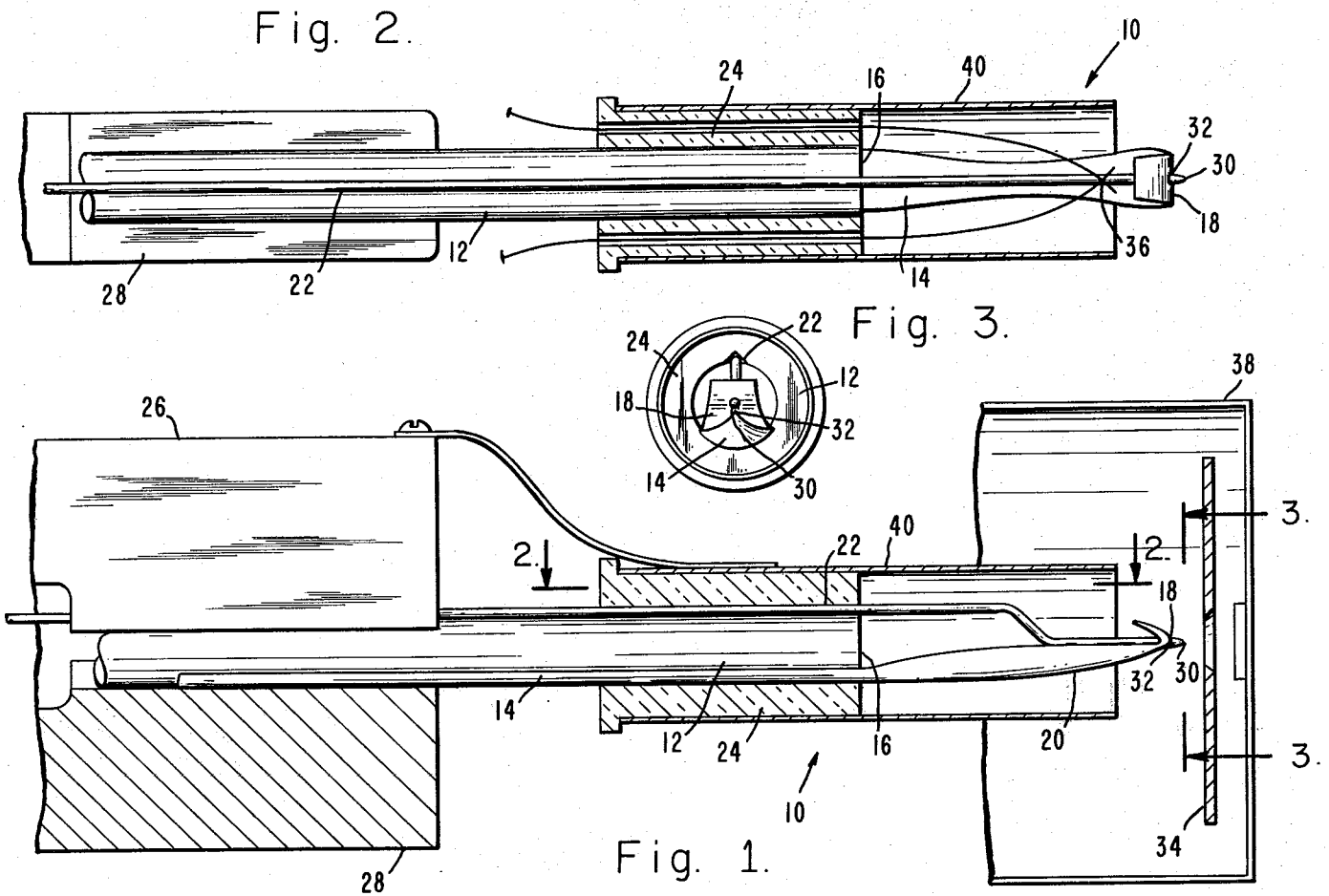
FIG. 1 is side elevational view of the liquid metal ion source of this invention, with parts broken away and parts taken in section.
FIG. 2 is plan view of the ion source, as seen generally along line 2—2 of FIG. 1, with parts removed and other parts broken away and taken in section.
FIG. 3 is a front elevational view of the needle tip structure, as seen generally along lines 3—3 of FIG. 1.

The ion source of this invention is generally indicated at 10 in FIGS. 1 and 2. The main structural member of ion source 10 is body 12 which is in the form of an insulator rod of cylindrical configuration. Heater ribbon 14 lies against the bottom of body 12 and extends forward beyond the front face 16 of the body to an apex 18 at which the heater ribbon is folded back for a short distance to form a hook. In order to provide strength to the portion of the heater ribbon 14 which extends beyond front face 16, the heater ribbon is folded at fold line 20 to form a V-shape, with a V open upwardly toward to center line of body rod 12. The center axis of the cylindrical body rod 12 defines the central axis of the ion source, as a convenient reference point. Apex 18 lies on that axis. The free end of heater ribbon 14 upward and leftward from the fold at the apex 18 forms an enclosure at the apex to receive fuel material and thus serves as a reservoir for the fuel material.

Needle 22 lies on top of body rod 12. The heater ribbon 14 and needle 22 are retained in place by means of tubular insulator bushing 24 which fits over the needle, heater ribbon and forward end of body rod 12 and lies even on the right hand with the front face 16 of the body rod. As seen in FIG. 3, bushing 24 has a V groove for accepting and clamping needle 22. If desired, the V groove could instead be formed on the exterior of body rod 12.

Clamp blocks 26 and 28 are metallic to serve as electric connections respectively to needle 22 and heater ribbon 14, and the clamp blocks engage the needle and heater ribbon and clamp them onto body rod 12. The clamp blocks thus serve to position ion source 10 in place. The clamp slots through the jaws of the clamp blocks are of uniform dimension so that the ion source can be moved from left to right to properly position it in its chamber.

Needle 22 extends forward beyond front face 16 and is bent downward to lie on the axis of the ion source. Needle 22 has point 30 which extends through needle opening 32 in the apex 18 of heater ribbon 14. The needle opening 32 is of such shape as to physically contact the needle just below its point, but still provide some open passage from the interior of the apex fold, which is the fuel reservoir, to the needle tip to provide omindirectional support for the needle while not restraining it axially. A triangular needle opening meets these requirements. This structure is such that the distance that point 30 extends beyond apex 18 as initially adjustable, and the distance between the point and extraction electrode 34 is also adjustable.

Thermocouple 36 is welded to needle 22 behind its point 30 near the reservoir region so that needle temperature can be measured and controlled. The thermocouple leads are led backward away from the tip through side holes in insulator bushing 24, as seen in FIG. 2.

Ion source 10 is placed in vacuum vessel 38 and is cleaned by heating it in a vacuum to a sufficiently high temperature so that the ion source cleans itself by evaporation. Heater current is supplied during this cleaning process, and heater current flows down the needle 22 to the needle opening 32 where the needle is in contact with heater ribbon 14. Typically the hottest point is at the needle opening 32, where the circuit resistance is the highest. After cleaning, fuel material is installed within the reservoir within the fold at apex 18. The fuel material is in powdered or granular form or in the form of small pieces of strip. It is lodged behind the heater apex within the reservoir region behind the apex fold. Preferably, the fuel material is slightly behind the contact of the needle with needle opening 32. When ion source 10 is again heated in vacuum, the fuel material melts, wets the needle and flows toward the hottest point, which is the contact point between the needle and needle opening 32, and thence flows out onto the needle tip. When the melt is completed a symmetrical meniscus of material forms within the reservoir around the needle, where it continues to feed the needle tip through the needle opening 32. Initially, the unmelted fuel material does not effectively short out the heating circuit near the needle opening 32 to thus provide for the wetting of the tip and the interior reservoir apex. This provides the proper forward material flow and meniscus formation. Once the needle tip is properly coated and the meniscus properly formed, the device will continue to operate correctly even though the resistance at the apex at the needle opening 32 has been lowered due to the presence of the fuel material.

The ion source continues to operate successfully because surface tension of the meniscus tends to hold the fuel material meniscus within the reservoir apex. Furthermore, heat from the plasma ball in front of the needle tip during ion extraction and/or secondary electron bombardment heating of the needle tip produces a positive temperature gradient from the needle opening to the needle tip, thereby promoting material flow to the needle tip.

When the fusing and wetting procedure as been completed, the heat and evaporation shield 40 is put in place by placing it on the exterior of insulator bushing 24. The shield is electrically biased by attaching it by strap to the clamp block 26.

Shield 40 may be single or multilayered as temperature requirements dictate. The choice of materials for construction of the shield is not as stringently limited as for the needle and heater. However, it must be made of metal so that it can be biased, but the metal should not exhibit high reactability with the fuel material.

Ions are extracted from needle tip 30 by heating the ion source 10 to a temperature somewhat past the melting point of the fuel material and then applying a sufficiently high voltage between the needle tip 30 and the extractor electrode 34. Usually, the extractor electrode is near ground potential. All or a portion of the ion current flows through the hole in the extractor electrode 34 depending on the amount of ion current drawn or the spacing between the tip and the extraction electrode 34.

Any formable, conductive material may be used to form needle 22 and heater ribbon 14. Molybdenum, tungsten, nickel and tantalum have been used. The compatibility of these materials with the fuel material is the determining factor. Alumina is the preferred material for body insulating rod 12 because it is commercially available in cylindrical rod form. Machinable ceramic may be used to make insulator bushing 24 when extended operation up to 800° C. is planned. Alumina should be used for higher temperatures.

The ion source thus described is a useful liquid metal ion source which is easily refillable, due to its open design with the reservoir material being supplied in liquid, powder, granular or strip form. The ion source is easily cleaned by evaporation before the filling of fuel, and can be refilled with a different fuel material after the old fuel material is evaporated away. With the directly heated needle, the needle tip is essentially the hottest point so that the heat is supplied at the most desirable location, where the fuel is positioned and adjacent to the ionization point. The portion of the needle extending beyond the heater apex can be initially adjusted before it is used with fuel. The needle tip extension can be adjusted at that time by manipulation of the shank.

The needle is restrained from bending which would cause the tip to move off axis by: (1) the relatively loose fit between one needle and heater apex hole, and (2) the formed cantilevered structure of the heater.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A liquid metal ion source comprising:

a body of electrical insulation material, said body having a face;

a strip heater having a folded apex and having a first leg extending from said apex, said leg being engaged on said body so that said apex is positioned beyond said face, an opening in said strip heater at said apex, said strip heater being made of metallic material;

a metallic needle positioned with respect to said body and extending beyond said face and extending through said opening in said apex, said needle being in contact with said strip heater, said needle having a pointed needle tip positioned beyond said apex, said first leg and said needle being connectable to a heater electric power supply for electrically heating said strip heater at said apex by current through said strip heater leg and said needle so that metal can be melted within said apex of said strip heater and against said needle so that liquid metal flows out to said needle point so that ions can be emitted at said needle point from the liquid metal.

2. The liquid metal ion source of claim 1 wherein said insulator body is a cylindrical insulator body and said first leg of said strip heater is engaged on the side of said cylindrical insulator body.

3. The liquid metal ion source of claim 2 wherein an insulator bushing is positioned around said leg of said heater to clamp said strip heater leg onto said insulator body.

4. The liquid metal ion source of claim 3 wherein a shield is mounted on said bushing and extends forward from said face to surround at least a part of the heater forward of said face.

5. The liquid metal ion source of claim 4 wherein a first metallic clamp block engages upon said first heater leg and upon said insulator body to electrically connect to said first heater leg and position said heater strip apex.

6. The liquid metal ion source of claim 5 wherein said needle is positioned on the other side of said cylindrical insulator body and there is a second clamp block which engages on said needle.

7. A liquid metal ion source comprising:

a body of electrical insulation material, said body having a face;

a strip heater having a transversely folded apex and having a first leg extending from said apex, said leg being engaged on said body so that said apex is positioned beyond said face, at least a part of said heater leg between said face and said apex having a longitudinal fold line therein to strengthen said heater leg between said face and said apex, an opening in said strip heater at said apex, said strip heater being made of metallic material;

a metallic needle positioned with respect to said body and extending beyond said face and extending through said opening in said apex, said needle being in contact with said strip heater, said needle having a pointed needle tip positioned beyond said apex, said first leg and said needle being connectable to a heater electric power supply for electrically heating said strip heater at said apex by current through said strip heater leg and said needle so that metal can be melted within said apex of said strip heater and against said needle so that liquid metal flows out to said needle point so that ions can be emitted at said needle point from the liquid metal.

8. The liquid metal ion source of claim 7 wherein an insulator bushing is positioned around said leg of said heater to clamp said strip heater leg onto said insulator body.

9. The liquid metal ion source of claim 8 wherein a shield is mounted on said bushing and extends forward from said face to surround at least a part of the heater forward of said face.

10. The liquid metal ion source of claim 9 wherein said insulator body is a cylindrical insulator body and said first leg of said strip heater is engaged on one side of said cylindrical insulator body.

11. The liquid metal ion source of claim 10 wherein said needle is positioned on the other side of said cylindrical insulator body.

12. A liquid metal ion source comprising:

a cylindrical body of electrical insulation material, said body having a face;

a strip heater having a folded apex and having a first leg extending from said apex, said leg being engaged on one side of said cylindrical insulator body so that said apex is positioned beyond said face, an opening in said strip heater at said apex, said strip heater being made of metallic material;

a metallic needle positioned on the other side of said cylindrical insulator body from said leg so that said needle extends beyond said face and extends through said opening in said apex, said needle being in contact with said strip heater, said needle having a pointed needle tip positioned beyond said apex, said first leg and said needle being connectable to a heater electric power supply for electrically heating said strip heater at said apex by current through said strip heater leg and said needle so that metal can be melted within said apex of said strip heater and against said needle so that liquid metal flows out to said needle point so that ions can be emitted at said needle point from the liquid metal.

* * * * *